US005875974A

United States Patent [19]

Kwiatek

[11] Patent Number: 5,875,974

[45] Date of Patent: Mar. 2, 1999

[54] WAVE WASHER PORT RING GAS TOP BURNER

[75] Inventor: David J. Kwiatek, LaGrange, Ill.

[73] Assignee: Ranco of Delaware, Wilmington, Del.

[21] Appl. No.: 58,021

[22] Filed: Apr. 10, 1998

[51] Int. Cl.[6] ..... B05B 1/14

[52] U.S. Cl. ..... 239/554; 239/555; 126/39 H

[58] Field of Search ..... 239/555, 554; 126/39 R, 39 H

[56] References Cited

U.S. PATENT DOCUMENTS 766,636 8/1904 Machlet ..... 239/554

2,235,635 3/1941 Hernan ..... 239/555

*Primary Examiner*—Carroll B. Dority

*Attorney, Agent, or Firm*—Leydig, Voit & Mayer, Ltd.

[57] ABSTRACT

A surface gas burner assembly for a gas range comprises a circular burner base having a gas inlet portion, a gas plenum portion, and a gas port portion. The gas port portion comprises a raised wall around an outer periphery of the base having a top surface. A wave washer port ring having an upper surface and a lower surface is also included. This upper surface comprises a upper mounting surfaces defining a plurality of upper gas port channels. The lower surface comprises lower mounting surfaces also defining a plurality of lower gas port channels. A circular burner cap has a raised wall around its outer periphery which includes a bottom surface. The lower mounting surfaces of the wave washer port ring are positioned on upper surface of the first raised wall to form a gas ports in conjunction with the plurality of lower gas port channels. The lower surface of the second raised wall is positioned on the upper mounting surfaces of the wave washer port ring to form gas ports in conjunction with the plurality of upper gas port channels.

18 Claims, 2 Drawing Sheets

WAVE WASHER PORT RING GAS TOP BURNER

FIELD OF THE INVENTION

This invention relates to consumer home appliances, and more particularly to gas ranges having cook burner tops included therewith.

BACKGROUND OF THE INVENTION

A typical gas range, for home or commercial use, includes a plurality of surface gas burners in addition to an oven and possibly a broiler compartment. Additionally, gas cook tops, having surface burners only, have become popular in recent years, boosting the use of gas for cooking. However, in order to compete with the other methods of cooking, designers of gas range surface burners have come under increasing pressure to reduce the cost and size of these devices while at the same time increasing the reliability and cooking efficiency thereof. However, certain design constraints in a typical surface gas burner construction have heretofore limited the advances capable in this area.

A typical surface gas burner is constructed from two components. The first component is the gas burner base which forms the gas inlet, plenum, and typically the plurality of gas ports defined between salients on the outer periphery of the base. The gaseous fuel exits these ports, forming the cooking flames once ignited. The second component which is used to construct a typical surface gas burner is the gas burner cap. This gas burner cap typically has a flat lower surface and sits on the burner base forming the upper walls for the plurality of gas burner ports in the burner base. This typical gas burner cap, being a solid piece, also forms the upper wall of the gas plenum into which the gaseous fuel flows prior to exiting the gas ports.

This typical construction, while having been used for years, carries with it a relatively significant manufacturing cost due to the necessity of machining the gas ports within the base of the surface burner. This machining process creates a plurality of salients which form the two side and bottom walls of the gas port (the lower surface of the burner cap forming the top wall of the gas port). In order to avoid breakage of these salients, a minimum thickness is required, thus limiting the number and size of the gas ports which may be machined into the surface gas burner of a given circumference.

This limitation has a practical impact on the surface gas burner particularly as a desire for increased BTU output continues to rise. Since the required wall thickness limits the total burner port area and number of burner ports which may be included in a surface gas burner of a given circumference, the increased gas flow necessary to increase the BTU output results in an increased length in the primary gas flames produced by the burner. As these primary gas flames extend beyond a given length, safety concerns are raised, and the efficiency and usefulness of the burner decreases, particularly when using cookware having a small circumference bottom surface. In order to allow for an increased BTU output, designers heretofore have been forced to increase the circumference of the surface gas burner to allow for adequate gas port area while avoiding the long primary gas flames produced by smaller circumference burners. However, once again a large circumference surface gas burner has decreased usefulness for smaller circumference cookware.

SUMMARY OF THE INVENTION

It is, therefore, an object of the instant invention to overcome many of these and other problems existing in the art. More specifically, it is an object of the invention to provide a new and useful surface gas burner for use with gas ranges and gas cook tops. Further, it is an object of the instant invention to provide a surface gas burner having a reduced cost of manufacturing while enjoying an increased reliability and cooking efficiency with increased BTU output for a given circumference burner.

In view of these objects it is a feature of the instant invention to provide a surface gas burner having an increased gas port area for a given circumference surface gas burner. Further, it is a feature of the instant invention to provide a surface gas burner having decreased length primary gas flames for a given BTU output of the surface gas burner. It is also a feature of the instant invention to provide a surface gas burner which requires no machining of the burner base or burner cap to form the plurality of gas ports. It is an additional feature of the instant invention to provide a surface gas burner having substantially more surface gas ports on a given circumference surface gas burner than was heretofore possible while maintaining adequate wall thickness to avoid premature fatigue and failure of the burner.

In an embodiment of the instant invention, a gas burner comprises a burner base having a gas port support ledge formed around its outer periphery, a burner cap having a gas port mating surface formed around its outer periphery and coincident to the gas port support ledge, and a wave washer port ring positioned between the gas port support ledge and the gas port mating surface. This wave washer port ring has an upper surface and a lower surface. Preferably, at least a portion of the upper surface operatively contacts the gas port mating surface to form a first plurality of gas ports. Additionally, at least a portion of the lower surface operatively contacts the gas port support ledge to form a second plurality of gas ports.

In a preferred embodiment, the gas burner further comprises burner cap positioning elements for establishing and maintaining a proper position relationship between the burner cap and the burner base. Preferably, this positioning element comprises at least one positioning pin extending from a lower surface of the burner cap and at least one positioning shank defined by the burner base and defining at least one positioning orifice. The positioning pin mates with the positioning orifice to properly locate the cap in coincidence with the burner base. The positioning orifice and the positioning pin may be threaded to allow the positioning pin to threadably engage the orifice.

In a preferred embodiment, the gas port support ledge is outwardly upwardly angled, and the gas port mating surface is inwardly downwardly angled in coincidence to the gas port support ledge. This gas port support ledge may be outwardly upwardly angled at an angle between 10° and 60°, and preferably at an angle of between 20° and 45°.

Both the upper surface and the lower surface of the wave washer port ring define a plurality of periodic convolutions which are interspersed with each other. Preferably, the upper surface of the wave washer port ring defines a plurality of periodic upper mounting surfaces having a plurality of periodic upper gas port channels defined therebetween. The lower surface of the wave washer port ring also defines a plurality of periodic lower mounting surfaces having a plurality of periodic lower gas port channels defined therebetween. These upper mounting surfaces and the lower gas port channels are preferably oppositely disposed to one another, as are the lower mounting surfaces and the upper gas port channels. The burner cap and the wave washer port ring may be removable from the burner base, or alternatively, may be fixably attached to one another.

In an alternate embodiment of the instant invention, a surface gas burner assembly for a gas range comprises a circular burner base having a gas inlet portion, a gas plenum portion, and a gas port portion. The gas port portion comprises a raised wall around an outer periphery of the base. This raised wall has an outer surface, a top surface, and an inner surface. The gas plenum portion is defined by a bottom surface and the inner surface of the first raised wall. The gas port portion comprises a cylindrical gas inlet integrally formed with the bottom wall and defining a channel therein allowing gaseous communication between a source of gaseous fuel and the gas plenum portion.

This embodiment further includes a wave washer port ring having an upper surface and a lower surface with the upper surface comprising a plurality of upper mounting surfaces defining a plurality of upper gas port channels therebetween, and the lower surface comprising a plurality of lower mounting surfaces defining a plurality of lower gas port channels therebetween. A circular burner cap having an upper surface, a lower surface, and a raised wall around an outer periphery of the burner cap is also included. This raised wall has an outer surface, an inner surface, and a bottom surface. The lower mounting surfaces of the wave washer port ring are positioned on the upper surface of the raised wall which forms a plurality of gas ports in conjunction with the plurality of the lower gas port channels. The lower surface of the other raised wall is positioned on the upper mounting surfaces of the wave washer port ring. This lower surface of the other raised wall also forms a second plurality of gas ports in conjunction with the plurality of upper gas port channels.

The upper mounting surfaces and the lower gas port channels are preferably oppositely disposed to one another, as are the lower mounting surfaces and the upper gas port channels. Additionally, the upper surface of the raised wall is outwardly upwardly angled, and the lower surface of the other raised wall is inwardly downwardly angled. The wave washer port ring is also angled in this embodiment to accommodate positioning between these two surfaces. Preferably, the first raised wall is outwardly upwardly angled by an angle between about 10 and 60 degrees, and may be between about 20 and 45 degrees. The other raised wall is inwardly downwardly angled by an angle approximately equal to the first angle.

In a surface gas burner assembly of a preferred embodiment of the instant invention, the bottom wall of the burner base, the inner surface of the first raised wall, the inner surface of the second raised wall, and the lower surface of the burner cap form a burner interior gas plenum. This burner interior gas plenum has a gas inlet defined by the channel of the gas inlet portion and a plurality of gas outlets defined by the first and the second plurality of gas ports.

In a further alternate embodiment of the instant invention, a gas burner assembly comprises a base, a cap, and a wave washer port ring positioned between the base and the cap. This wave washer port ring forms a plurality of outlet gas ports alternately between the base and the cap.

These and other aims, objectives, and advantages of the invention, will become more apparent from the following detailed detailed description while taken into conjunction with the accompanying drawings.

Figure 1:
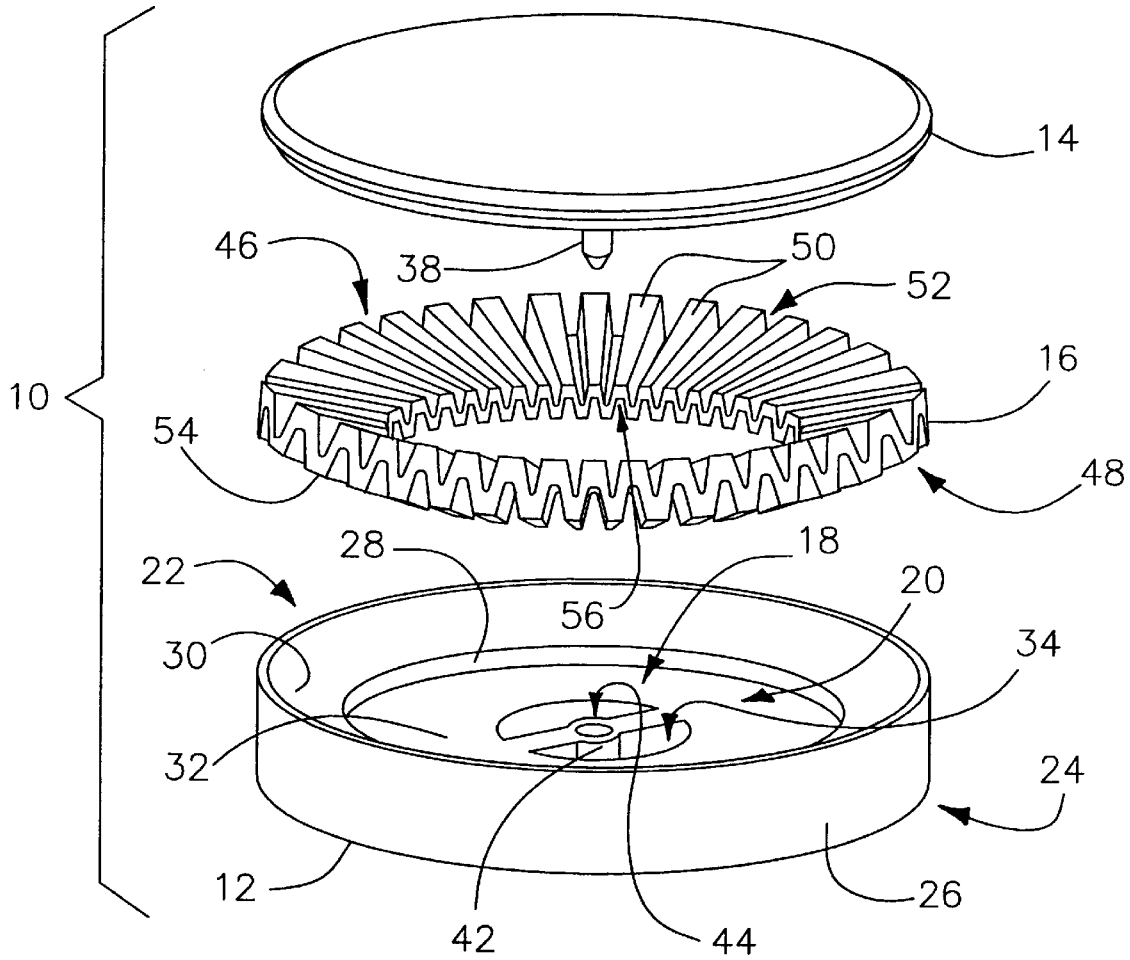
FIG. 1 is an exploded isometric view of a surface gas burner constructed in accordance with an embodiment of the instant invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

An embodiment of a gas burner 10 assembled in accordance with the teachings of the instant invention is illustrated in FIG. 1 in exploded isometric form. As may be seen from this figure, the gas burner 10 comprises a burner base 12, a burner cap 14, and a wave washer port ring 16. Preferably, the burner base 12 is generally circular in configuration to allow an equal distribution of gaseous fuel delivered to its outer periphery for ignition. It will be recognized by one skilled in the art, however, that other configurations of the burner 10, including but not limited to, elongated burners may be utilized as desired for particular applications without leaving the spirit and scope of the invention.

The gas burner base 12 includes a gas inlet portion 18, a gas plenum portion 20, and a gas port portion 22. This gas port portion 22 comprises a raised wall 24 having an outer surface 26, an inner surface 28 and a top surface 30. The top surface 30 serves to form a gas port support ledge whose function will be described more fully below. This raised wall portion 24 around the outer periphery of the base 12 may utilize a top surface 30 which is substantially horizontal, or which slopes either upwardly or downwardly as desired. In a preferred embodiment of the instant invention, the top surface 30 is outwardly upwardly angled relative to its normal orientation on a surface gas range. Preferably, the angle at which the surface 30 is angled is between about 10 and 60 degrees, and preferably between about 20 and 45 degrees.

The inner surface 28 of the raised wall 24, in combination with a bottom surface 32 defines the gas plenum portion 20 of the base 12. Gaseous fuel is supplied to this plenum area 20 through a channel 34 which is defined by a cylindrical gas inlet 36 (see FIG. 2). In the embodiment illustrated in this FIG. 1, a burner cap positioning means, illustrated as comprising at least one positioning pin 38 extending from a lower surface 40 (see FIG. 2) of the burner cap 14, and at least one positioning shank 42 in the burner base 12. Preferably, the positioning pin 38 mates with an orifice 44 defined in the positioning shank 42 to properly locate the cap in coincidence with the burner base. This orifice 44, as well as the positioning pin 38 may be threaded as desired to allow the burner cap 14 to be removably secured to the burner base 12. It will be recognized by one skilled in the art that alternate embodiments of the burner cap positioning means may be utilized, including embodiments which include positioning pins or studs coupled to or integral with the burner base 12 and mating with the burner cap 14 as is known in the art.

The wave washer port ring 16 illustrated in FIG. 1 has an upper surface 46 and a lower surface 48. The upper surface comprises a plurality of upper mounting surfaces 50 which have defined therebetween a plurality of upper gas port channels 52. Likewise, the lower surface 48 also has a plurality of lower mounting surfaces 54 which have defined therebetween a plurality of lower gas port channels 56. As may be seen from this illustration, the upper surface of the wave washer port ring 16 contains a plurality of periodic convolutions alternating between peak and crest, with the peaks defined as the upper mounting surfaces 50. The lower surface of the wave washer port ring 16 also includes these periodic convolutions, but are so positioned as to intersperse its convolutions with those of the upper surface 46. This results in lower surface crests in coincidence with upper surface peaks and vice versa. This allows for maximization of the gas port area while maintaining sufficient wall thickness to prevent inadvertent breaking and early fatigue and failure of this component of the gas burner 10.

Figure 2:
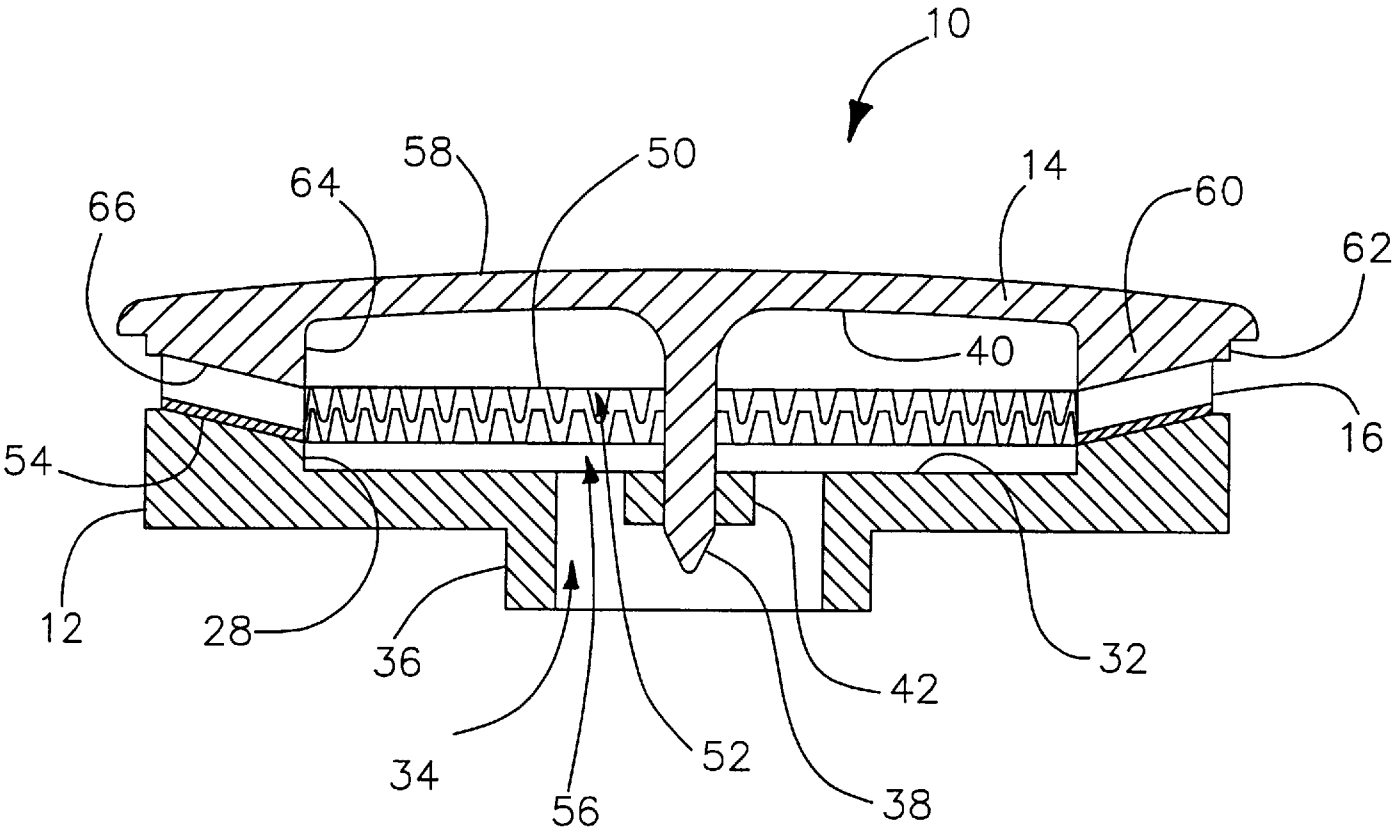
FIG. 2 is a mechanical cross-sectional view of the gas burner of FIG. 1 constructed in accordance with an embodiment of the instant invention.

A cross sectional illustration of an embodiment of a surface gas burner constructed in accordance with the teachings of the instant invention is illustrated in FIG. 2, to which reference is now specifically made. As may be see from this figure, the burner cap 14 has the same general geometrical configuration as the burner base 12, in this case circular. This cap 14 has an upper surface 58, a lower surface 40, and a raised wall 60 around the outer periphery of the burner cap 14. This raised wall 60 includes an outer surface 62, an inner surface 64, and a bottom surface 66 which serves as a lower gas port mating surface as will be described below.

This raised wall 60 around the outer periphery of the burner cap 14 may utilize a bottom surface 66 which is substantially horizontal, or which slopes either upwardly or downwardly as desired in coordination with the top surface 30 of the burner base 12 and the wave washer port ring 16. In a preferred embodiment of the instant invention, the bottom surface 66 is inwardly downwardly angled relative to its normal orientation on a surface gas range to define a gas port of approximately equal height along its length from the inner to the outer periphery. Gas ports of varying height are also possible by differing angles between the upper surface 30 and the bottom surface 66. In such a situation, preferably the height of the wave washer port ring 16 would vary to maintain contact with the upper surface 30 and the bottom surface 66.

It should be noted that while the embodiment illustrated in FIG. 2 includes a gas plenum area defined by the inner surface 64 and the lower surface 40 of the burner cap 14, such area need not be present, and the cap 14 may instead comprise a solid piece from the burner cap's lower surface 66 which serves as a gas port mating surface around the outer periphery of the burner cap. However, the inclusion of this plenum area allows for use of less material in the construction of the burner cap 14, thereby lowering the cost of manufacture of this component.

This embodiment of the instant invention is constructed by placing the wave washer port ring 16 on the burner base 12 so that the lower mounting surfaces 54 are seated on the upper surface 30 of the raised wall 24 (see FIG. 1). This seating forms a plurality of gas ports defined by the upper wall 30 and the gas port channels 56 around the periphery of the burner 10. The burner cap 14 is then seated on the upper mating surfaces 50 of the wave washer port ring 16, having this lower gas port mating surface 66 positioned in coincidence with the gas port support ledge 30 of the base 12 (see FIG. 1). The seating of the burner cap 14 on the upper mating surfaces 50 of the wave washer port ring 16 also forms a plurality of gas ports around the outer periphery of the burner 10 which are defined by this lower gas port mating surface 66 and the gas port channels 52.

One skilled in the art will recognize that while the assembly of the burner 10 of the embodiment of the instant invention illustrated in FIGS. 1 and 2 contemplate a disassembable construction utilizing either a simple locating pin 38 or possibly a threaded connection, this burner may be constructed such that the individual components are fixedly attached to one another through any known process applicable to the surface burner environment. However, for ease of cleaning, manufacture, and replacement, the components of the burner 10 are preferably removable. Likewise, the materials utilized to construct these components may be any acceptable material for gas burner construction, and may be made by any acceptable process, the details of which are known.

A burner constructed in accordance with the teachings of the instant invention, such as the embodiment illustrated in FIGS. 1 and 2, have a decreased cost of manufacturing due to the obviation of the requirement to machine either the burner base or the burner cap to include the gas port channels. Burners constructed in accordance with the teachings of the instant invention also have an increased number of ports than that capable of being machined into either the base or the cap for a given circumference gas burner. Burners constructed in accordance with the teachings of the instant invention, therefore, allow for a significant increase in the burner port are available for a given circumference burner. This results in an increased BTU rating of the burner and a reduced primary gas flame length for the same BTU rating of a conventional gas burner.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. The details of the structure and architecture may be varied substantially without departing from the spirit of the invention, and the exclusive use of all modifications which come within the scope of the appended claims is reserved.

What is claimed is:

1. A gas burner assembly, comprising;

a base having an outwardly upwardly angled top surface;

a cap having an inwardly downwardly angled lower surface; and a wave washer port ring positioned between said base and said cap forming a plurality of outlet gas ports alternately between said base and said cap, said wave washer port ring having a lower surface conforming to said upper surface of said base, and an upper surface conforming to said lower surface of said cap.

2. The gas burner of claim 1, further comprising burner cap positioning means for establishing and maintaining a proper position relationship between said burner cap and said burner base.

3. The gas burner of claim 2, wherein said burner cap positioning means comprises at least one positioning pin extending from a lower surface of said burner cap and at least one positioning shank defined by said burner base, said at least one positioning shank defining at least one positioning orifice therein, and wherein said at least one positioning pin mates with said at least one positioning orifice to properly locate said cap in coincidence with said burner base.

4. The gas burner of claim 3, wherein said positioning orifice and said positioning pin are threaded, and wherein said positioning pin threadably engages said orifice.

5. The gas burner of claim 1, wherein said upper surface of said wave washer port ring defines a first plurality of periodic convolutions, wherein said lower surface of said wave washer port ring defines a second plurality of periodic convolutions, and wherein said first plurality of periodic convolutions are interspersed with said second plurality of periodic convolutions.

6. The gas burner of claim 1, wherein said top surface substituted is outwardly upwardly angled at an angle between 10° and 60°.

7. The gas burner of claim 6, wherein said top surface substituted is outwardly upwardly angled at an angle between 20° and 45°.

8. The gas burner of claim 1, wherein said upper surface of said wave washer port ring defines a plurality of periodic upper mounting surfaces having a plurality of periodic upper gas port channels defined therebetween, and wherein said lower surface of said wave washer port ring defines a plurality of periodic lower mounting surfaces having a plurality of periodic lower gas port channels defined therebetween.

9. The gas burner of claim 8, wherein said upper mounting surfaces and said lower gas port channels are oppositely disposed to one another, and wherein said lower mounting surfaces and said upper gas port channels are oppositely disposed to one another.

10. The gas burner of claim 1, wherein said cap and said wave washer port ring are removable from said base.

11. The gas burner of claim 1, wherein said base, said wave washer port ring, and said cap are fixably attached to one another.

12. A surface gas burner assembly for a gas range, comprising:

a circular burner base having a gas inlet portion, a gas plenum portion, and a gas port portion, said gas port portion comprising a first raised wall around an outer periphery of said base, said first raised wall having an outer surface, a top surface, and an inner surface, said gas plenum portion being defined by a bottom surface and said inner surface of said first raised wall, said gas port portion comprising a cylindrical gas inlet integrally formed with said bottom wall, said gas inlet defining a channel therein allowing gaseous communication between a source of gaseous fuel and said gas plenum portion;

a wave washer port ring having an upper surface and a lower surface, said upper surface comprising a plurality of upper mounting surfaces defining a plurality of upper gas port channels therebetween, said lower surface comprising a plurality of lower mounting surfaces defining a plurality of lower gas port channels therebetween; and a circular burner cap having an upper surface, a lower surface, and a second raised wall around an outer periphery of said burner cap, said second raised wall having an outer surface, an inner surface, and a bottom surface; and wherein said lower mounting surfaces of said wave washer port ring are positioned on said upper surface of said first raised wall, said upper surface of said first raised wall forming a first plurality of gas ports in conjunction with said plurality of said lower gas port channels; and wherein said lower surface of said second raised wall is positioned on said upper mounting surfaces of said wave washer port ring, said lower surface of said second raised wall forming a second plurality of gas ports in conjunction with said plurality of said upper gas port channels.

13. The surface gas burner assembly of claim 12, wherein said upper mounting surfaces and said lower gas port channels are oppositely disposed to one another, and wherein said lower mounting surfaces and said upper gas port channels are oppositely disposed to one another.

14. The surface gas burner assembly of claim 12, wherein said upper surface of said first raised wall is outwardly upwardly angled, and said lower surface of said second raised wall is inwardly downwardly angled, and wherein said wave washer port ring is angled to accommodate positioning therebetween.

15. The surface gas burner assembly of claim 14, wherein said first raised wall is outwardly upwardly angled by a first angle between about 10 and 60 degrees.

16. The surface gas burner assembly of claim 15, wherein said first angle is between about 20 and 45 degrees.

17. The surface gas burner assembly of claim 15, wherein said second raised wall is inwardly downwardly angled by a second angle approximately equal to said first angle.

18. The surface gas burner assembly of claim 12, wherein said bottom wall of said burner base, said inner surface of said first raised wall, said inner surface of said second raised wall, and said lower surface of said burner cap form a burner interior gas plenum, said burner interior gas plenum having a gas inlet defined by said channel of said gas inlet and a plurality of gas outlets defined by said first and said second plurality of gas ports.

* * * * *